US008651190B2

(12) United States Patent
Dietz

(10) Patent No.: US 8,651,190 B2
(45) Date of Patent: Feb. 18, 2014

(54) SHEAR BOOST TRIGGERING AND BOTTLE REDUCING SYSTEM AND METHOD

(75) Inventor: David Albert Dietz, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 521 days.

(21) Appl. No.: 12/913,997

(22) Filed: Oct. 28, 2010

(65) Prior Publication Data

US 2012/0103629 A1 May 3, 2012

(51) Int. Cl.
*E21B 29/12* (2006.01)
*E21B 33/064* (2006.01)

(52) U.S. Cl.
USPC ..... 166/368; 166/361; 166/363; 166/250.01; 166/297; 251/1.1

(58) Field of Classification Search
USPC ..... 166/368, 344, 345, 361, 363, 250.01, 166/297, 298, 55, 85.4; 137/315.02; 251/1.1–1.3
See application file for complete search history.

(56) References Cited

U.S. PATENT DOCUMENTS 3,044,481 A * 7/1962 Regan ..... 137/114
3,921,500 A * 11/1975 Silcox ..... 91/4 R
3,987,708 A * 10/1976 Uhrich ..... 92/134
4,130,161 A * 12/1978 Jones ..... 166/337
4,413,642 A * 11/1983 Smith et al. ..... 137/14
4,508,313 A * 4/1985 Jones ..... 251/1.3
4,519,577 A * 5/1985 Jones ..... 251/62
4,923,008 A * 5/1990 Wachowicz et al. ..... 166/373
4,955,195 A * 9/1990 Jones et al. ..... 60/405
5,320,325 A * 6/1994 Young et al. ..... 251/1.3
5,407,172 A * 4/1995 Young et al. ..... 251/1.3
6,969,042 B2 * 11/2005 Gaydos ..... 251/1.3
7,274,989 B2 * 9/2007 Hopper ..... 702/6
2008/0185046 A1 * 8/2008 Springett et al. ..... 137/14
2008/0196888 A1 * 8/2008 Judge et al. ..... 166/250.07
2008/0197306 A1 * 8/2008 Judge ..... 251/1.3
2010/0152901 A1 * 6/2010 Judge et al. ..... 700/275
2011/0284236 A1 * 11/2011 Baugh ..... 166/363
2012/0048566 A1 * 3/2012 Coppedge et al. ..... 166/340

OTHER PUBLICATIONS

GB Search Report dated Jun. 6, 2012 from corresponding Application No. GB118498.3.
GB Search Report dated Jun. 7, 2012 from corresponding Application No. GB1118498.3.
GB Partial Search Report dated Feb. 27, 2012 from corresponding Application No. GB1118498.3.

* cited by examiner

*Primary Examiner* — Matthew Buck
(74) *Attorney, Agent, or Firm* — Bracewell & Giuliani LLP

(57) ABSTRACT

Systems can be configured to move a ram block in a blowout preventer. The system includes: a first bank of accumulators configured to provide a first pressure to move the ram block; a second bank of accumulators configured to provide a second pressure to move the ram block, wherein the second pressure is greater than the first pressure; and a controller configured to sequentially control the first bank of accumulators to apply pressure to move the ram block and to then control the second bank of accumulators to move the ram block after the first bank of accumulators has moved the ram block a first distance.

10 Claims, 11 Drawing Sheets

SHEAR BOOST TRIGGERING AND BOTTLE REDUCING SYSTEM AND METHOD

TECHNICAL FIELD

Embodiments of the subject matter disclosed herein generally relate to methods and devices and, more particularly, to mechanisms and techniques for shearing a drill string in a well.

BACKGROUND

Subsea oil and gas exploration becomes more challenging as the exploration depth increases. Complex devices are disposed on the ocean floor for extracting the oil and for the safety of the oil equipment and the environment. These devices have to withstand, among other things, high pressures (from 3,000 to 60,000 psi (200 to 4000 bar) or more) and highly corrosive conditions. For undersea drilling, parts are disposed on the ocean floor (sometimes more than 2000 m below sea level) as shown, for example, in FIG. 1.

FIG. 1 illustrates a lower blowout preventer stack ("lower BOP stack") 10 that may be rigidly attached to a wellhead 12 upon the sea floor 14, while a Lower Marine Riser Package ("LMRP") 16 is retrievably disposed upon a distal end of a marine riser 18, extending from a drill ship 20 or any other type of surface drilling platform or vessel. As such, the LMRP 16 may include a stinger 22 at its distal end configured to engage a receptacle 24 located on a proximal end of the lower BOP stack 10.

In typical configurations, the lower BOP stack 10 may be rigidly affixed atop the subsea wellhead 12 and may include (among other devices) a plurality of ram-type blowout preventers 26 useful in controlling the well as it is drilled and completed. The flexible riser provides a conduit through which drilling tools and fluids may be deployed to and retrieved from the subsea wellbore. Ordinarily, the LMRP 16 may include (among other things) one or more ram-type blowout preventers 28 at its distal end, an annular blowout preventer 30 at its upper end, and multiplexer (MUX) pod (in reality two, which are referred to in the industry as blue and yellow pods) 32. Additionally, accumulator tanks 31 are provided to provide pressure to move ram blocks of the associated BOPs 26 and while shown as a separate unit, the accumulator tanks 31 can be a part of the LMRP 16 as desired.

A conventional MUX pod system 40, is shown in FIG. 2 and may provide between 50 and 100 different functions to the lower BOP stack 10 and/or the LMRP 16 and these functions may be initiated and/or controlled from or via the LMRP 16. The MUX pod 40 is fixedly attached to a frame (not shown) of the LMRP 16 and may include hydraulically activated valves 50 (called in the art sub plate mounted (SPM) valves) and solenoid valves 52 that are fluidly connected to the hydraulically activated valves 50. The solenoid valves 52 are provided in an electronic section 54 and are designed to be actuated by sending an electrical signal from an electronic control board (not shown). Each solenoid valve 52 is configured to activate a corresponding hydraulically activated valve 50. The MUX pod 40 may include pressure sensors 56 also mounted in the electronic section 54. The hydraulically activated valves 50 are provided in a hydraulic section 58 and are fixedly attached to the MUX pod 40 (i.e., a remotely operated vehicle (ROV) cannot remove them when the same is disposed on the seafloor).

In typical subsea blowout preventer installations, multiplex cables (electrical) and/or lines (hydraulic) transport control signals via the MUX pod 40 and the pod wedge) to the LMRP 16 and lower BOP stack 10 devices so specified tasks may be controlled from the surface. Once the control signals are received, subsea control valves are activated and (in most cases) high-pressure hydraulic lines are directed to perform the specified tasks. Thus, a multiplexed electrical or hydraulic signal may operate a plurality of "low-pressure" valves to actuate larger valves to communicate the high-pressure hydraulic lines with the various operating devices of the wellhead stack.

A bridge between the LMRP 16 and the lower BOP stack 10 is formed that matches the multiple functions from the LMRP 16 to the lower BOP stack 10, e.g., fluidly connects the SPM valves 50 from the MUX pod 40 provided on the LMRP 16 to dedicated components on the BOP stack or the LMRP 16. The MUX pod 40 system is used in addition to choke and kill line connections (not shown) or lines that ensure pressure supply to, for example, the shearing functions of the BOPs.

Examples of communication lines bridged between LMRPs 16 and lower BOP stacks 10 through feed-thru components include, but are not limited to, hydraulic choke lines, hydraulic kill lines, hydraulic multiplex control lines, electrical multiplex control lines, electrical power lines, hydraulic power lines, mechanical power lines, mechanical control lines, electrical control lines, and sensor lines. In certain embodiments, subsea wellhead stack feed-thru components include at least one MUX pod 40 connection whereby a plurality of hydraulic control signals are grouped together and transmitted between the LMRP 16 and the lower BOP stack 10 in a single mono-block feed-thru component.

One apparatus for sealing a well is the BOP. The BOP is a safety mechanism that is used at a wellhead of an oil or gas well. The BOP is configured to shut the flow from the well when certain well events occur. One such well event may be the uncontrolled flow of gas, oil or other well fluids from an underground formation into the well. Such well event is sometimes referred to as a "kick" or a "blowout" and may occur when formation pressure exceeds the pressure generated by the column of drilling fluid. This well event is unforeseeable and if no measures are taken to prevent and/or control it, the well and/or the associated equipment may be damaged.

The BOP may be installed on top of the well to seal the well in case that one of the above events is threatening the integrity of the well. One type of BOP, an annular BOP, is conventionally implemented as a valve to release the pressure either in the annular space between a casing and a drill pipe or in the open hole (i.e., hole with no casing) during drilling or completion operations. Another type of BOP, a ram BOP, can be located below the annular BOP and above the wellhead. The different types of rams can generally be classified as, (1) casing shear rams for cutting drill pipe, casing, etc., (2) blind shear rams capable of both sealing on open hole and cutting drill pipe, casing, etc., and (3) pipe rams capable of sealing on pipe and hanging the drill still at a tool joint.

FIG. 3 shows a ram BOP 306 located in undersea environment in more detail. A wellhead 302 may be fixed to the seabed 304, and the ram BOP 306 is secured to the wellhead 302. FIG. 3 shows, for clarity, the ram BOP 306 detached from the wellhead 302. However, the BOP 306 is typically attached to the wellhead 302. A drill pipe 308 is shown traversing the ram BOP 306 and entering the well 310. The ram BOP 306 may have two ram blocks 312 attached to corresponding pistons 314. The pistons 314 move integrally with the ram blocks 312 along directions A and B to close the well.

In situations when the ram BOP 306 is used for shearing the drill pipe or other tools in the hole, having the desired shear strength and shared load through the desired load bearing surfaces is desired. This can be complicated by variable forces acting upon the system, such as, the reaction force produced by the drill line when asymmetrically disposed relative to the shear surface of the ram block 312, and a force produced by variable upward pressure from the kick or additional items inside of the drill pipe that also need to be sheared off to seal the well, e.g., a cable attached to a down hole piece of equipment, to name just a few examples.

In order to seal the well as desired, the MUX pod 40 includes a controller which controls a system of valves for opening and closing the BOPs. Hydraulic fluid, which is used to open and close the valves, is commonly pressurized by equipment on the surface. The pressurized fluid is stored in accumulators 31 to operate the BOPs. The fluid stored subsea in accumulators may also be used to auto shear and/or perform deadman functions when control of the well is lost. The accumulator 31 may include containers (canisters) that store the hydraulic fluid under pressure and provide the necessary pressure to open and close the BOPs.

As understood by those of ordinary skill, in deep-sea drilling, in order to overcome the high hydrostatic pressures generated by the seawater at the depth of operation of the BOPs, the accumulator 31 have to be initially charged to a pressure above the ambient subsea pressure. Typical accumulators are charged with nitrogen but as pre-charge pressures increase, the efficiency of nitrogen decreases which adds additional cost and weight because more accumulators are required subsea to perform the same operation on the surface. For example, a 60-liter (L) accumulator on the surface may have a usable volume of 24 L on the surface, but at 3000 m of water depth the usable volume is less than 4 L. An additional issue with accumulators 31 is that as the charge in the accumulator 31 is expended, the resulting pressure from the accumulator 31 is reduced as shown in FIG. 4. In FIG. 4, when a valve is opened to first use the accumulator 31, the pressure generated is $P_I$ at a volume $V_I$. As the volume of the charge is expanded, the pressure versus volume curve 402 shows that the available pressure decreases such that at a later usage point, an available pressure $P_2$ at a volume $V_2$ is lower than $P_I$. This could be a problem, if the available pressure from the accumulators 31 is lower than desired.

Accordingly, it would be desirable to provide systems and methods to have a desired pressure available for use whenever desired.

SUMMARY

According to an exemplary embodiment there is a system configured to move a ram block. The system includes: a first bank of accumulators configured to provide a first pressure to move the ram block; a second bank of accumulators configured to provide a second pressure to move the ram block, wherein the second pressure is greater than the first pressure; and a controller configured to sequentially control the first bank of accumulators to apply pressure to move the ram block and to then control the second bank of accumulators to move the ram block after the first bank of accumulators has moved the ram block a first distance.

According to another exemplary embodiment, there is a system configured to shear an object in a blow out preventer. The system includes: a pressure sensor configured to monitor a first pressure applied on a ram block of the blowout preventer and to transmit a signal representative of the first pressure to a controller; a first bank of accumulators configured to provide a second pressure to move the ram block until the ram block is substantially in contact with the object; a second bank of accumulators configured to provide a third pressure to move the ram block to shear the object, wherein the third pressure is greater than the second pressure; and the controller is configured to sequentially control the first bank of accumulators to move the ram block until the first pressure reaches a predetermined value and to then control the second bank of accumulators to move the ram block to shear the object.

According to another exemplary embodiment, there is another system configured to shear an object in a blowout preventer. The system includes: a first bank of accumulators configured to provide a first pressure to move a ram block until the ram block is substantially in contact with the object; a second bank of accumulators configured to provide a second pressure to move the ram block to shear the object, wherein the second pressure is greater than the first pressure; a relief valve connected to a pressure line and configured to open when the first pressure reaches a predetermined amount; and a conduit connected to the relief valve and configured to deliver a pressurized substance to open a pilot valve associated with the second bank of accumulators when the relieve valve opens.

According to another exemplary embodiment, there is yet another system configured to shear an object in a blowout preventer. The system includes: a position sensor configured to monitor a position of a ram block in the blowout preventer and to transmit the position of the ram block to a controller; a first bank of accumulators configured to provide a first pressure to move the ram block until the ram block is substantially in contact with the object; a second bank of accumulators configured to provide a second pressure to move the ram block to shear the object, wherein the second pressure is greater than the first pressure; and the controller is configured to calculate a velocity of the ram block and to sequentially control the first bank of accumulators to move the ram block until the velocity of the ram block is substantially zero and to then control the second bank of accumulators to move the ram block to shear the object.

According to another exemplary embodiment, there is yet another system configured to shear an object in a blowout preventer. The system includes: a lower marine riser package (LMRP); a multiplexor (MUX) pod attached to the LMRP and configured to provide functions to the BOP; the BOP configured to shear the object with a ram block; a position sensor configured to monitor a position of the ram block and to transmit the position of the ram block to a controller; a first bank of accumulators configured to provide a first pressure to move the ram block until the ram block is substantially in contact with the object; a second bank of accumulators configured to provide a second pressure to further move the ram block to shear the object, wherein the second pressure is greater than the first pressure; and the controller is disposed in the MUX pod and configured to sequentially control the first bank of accumulators to move the ram block until the ram block is substantially in contact with the object and to then control the second bank of accumulators to move the ram block to shear the object.

According to another exemplary embodiment, there is a method to shear an object in a blowout preventer. The method includes: determining a need to shear the object; monitoring a position of a ram block of the blowout preventer; transmitting the position of the ram block to a controller; providing a first pressure from a first bank of accumulators to move the ram block until the ram block is in contact with the object; providing a second pressure from a second bank of accumulators to move the ram block to shear the object; and shearing the object.

BRIEF DESCRIPTION OF THE DRAWINGS

The accompanying drawings illustrate exemplary embodiments, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
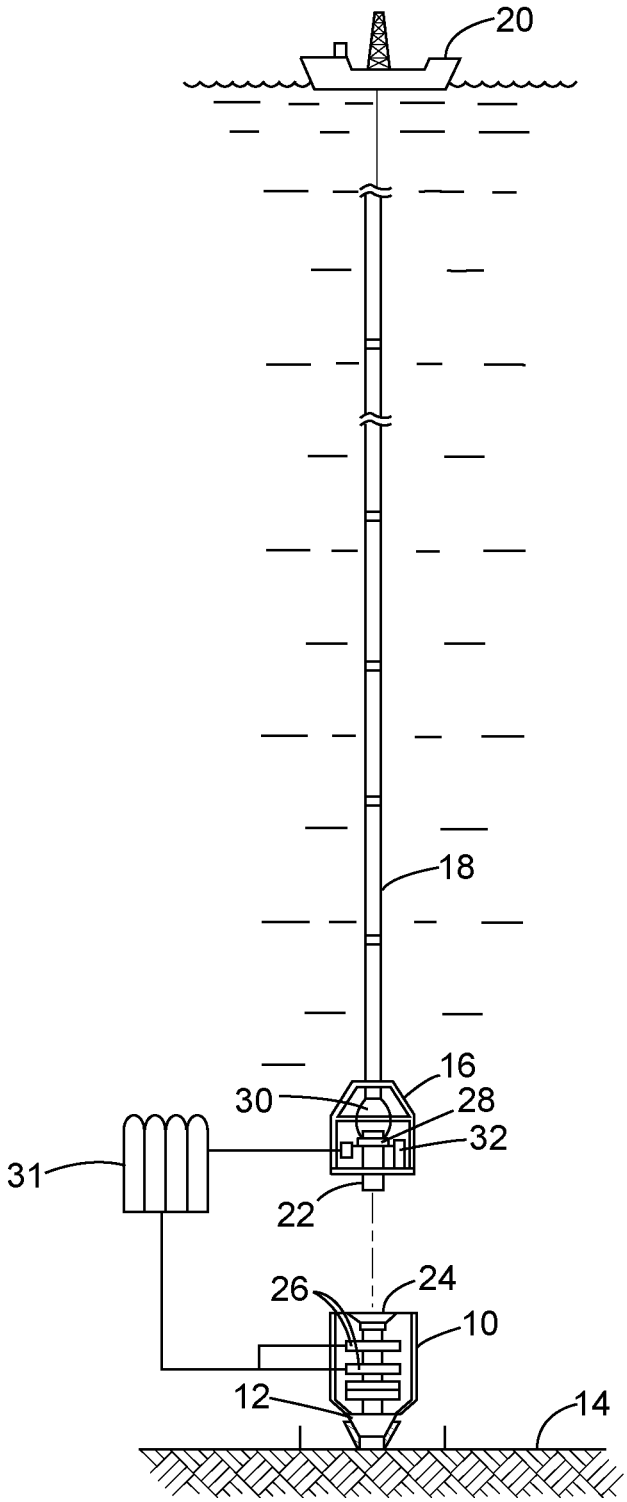
Figure 1 (Background Art)
FIG. 1 is a schematic diagram of a conventional offshore rig.
Figure 2:
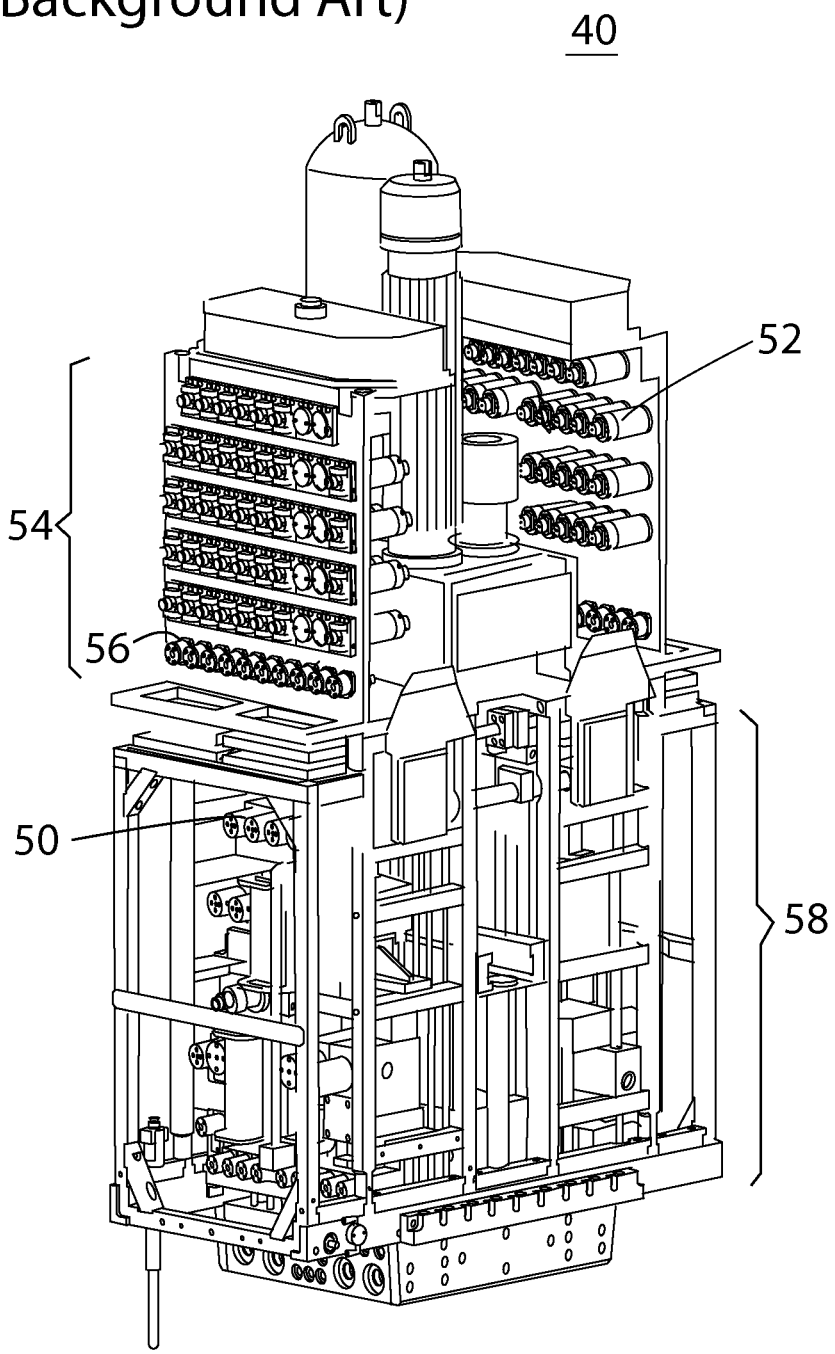
Figure 2 (Background Art)
FIG. 2 is a schematic diagram of a multiplexor (MUX) pod.
Figure 3:
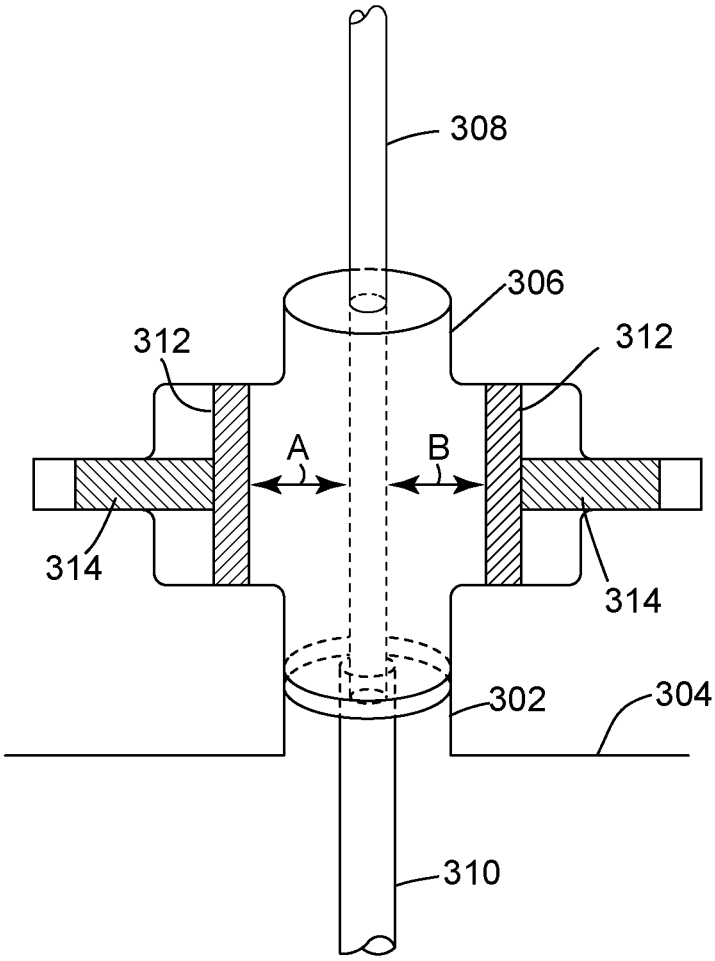
FIG. 3 Background Art
FIG. 3 is a schematic diagram illustrating a ram blowout preventer (BOP) disposed on top of the well.
Figure 4:
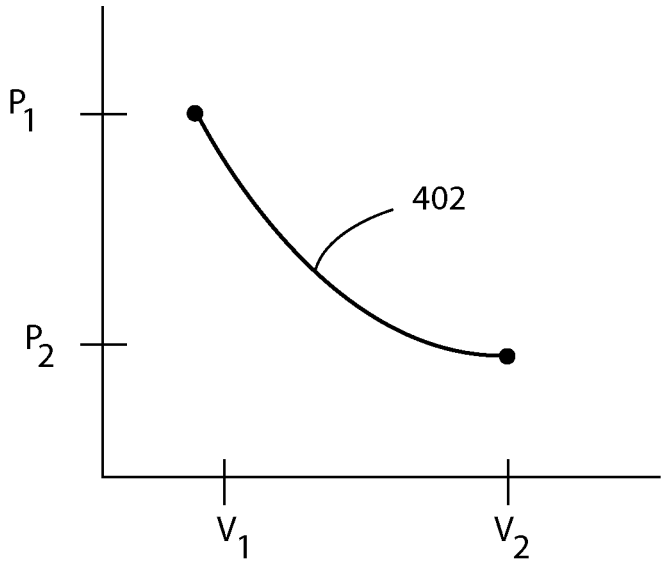
Figure 4 (Background Art)
FIG. 4 illustrates a pressure versus volume curve when using an accumulator.

As described in the Background section, as the charge in an accumulator is expended, the remaining pressure available from the accumulator is reduced. Systems and methods, according to exemplary embodiments, can have a desired pressure available for allowing a ram block to shear a drill string in a well from the accumulator (or bank of accumulators) whenever desired as well as providing control systems for their use. Exemplary systems and methods will generally operate in undersea well environments as shown in and described with respect to FIGS. 1-3.

Figure 5:
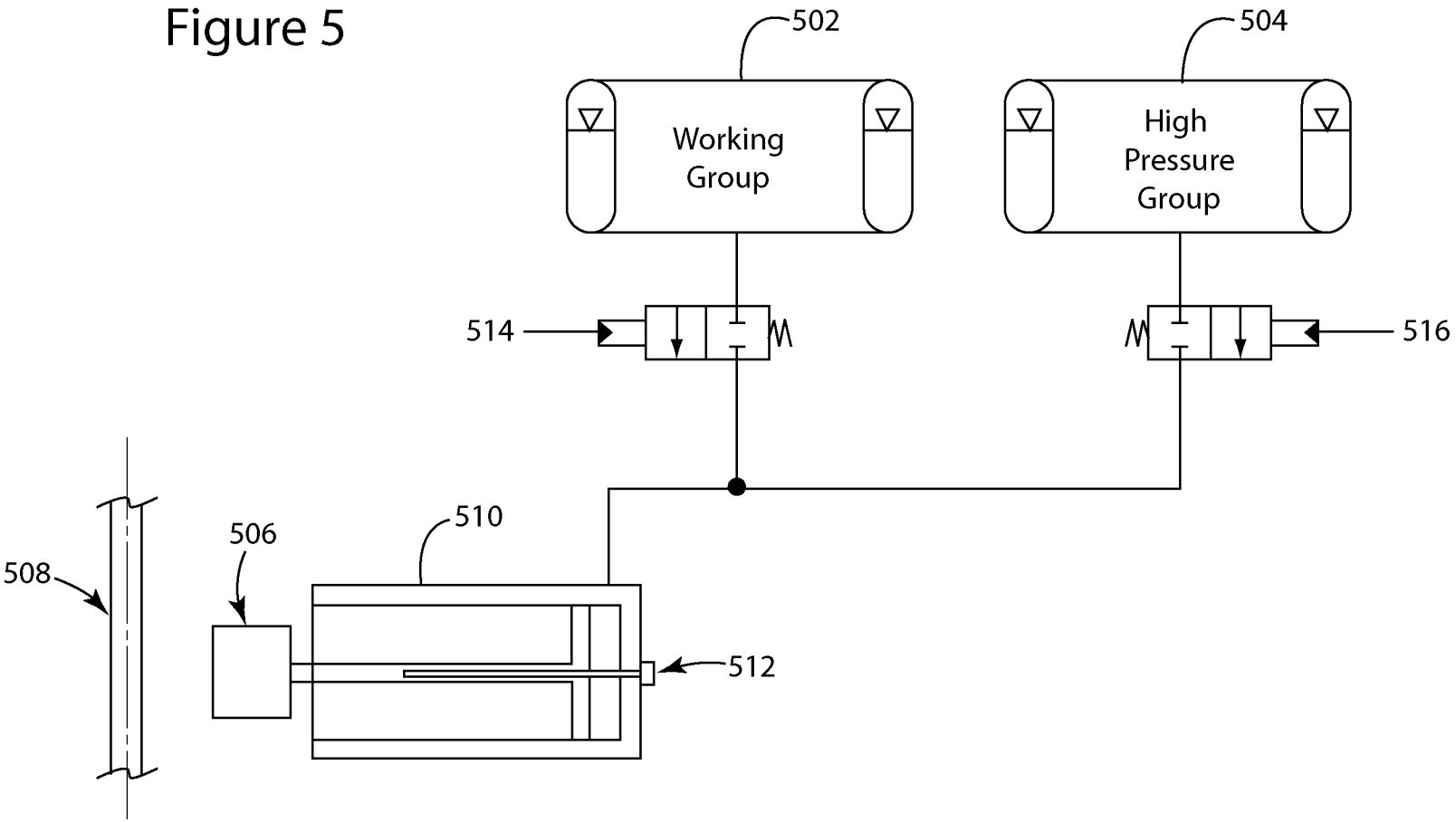
FIG. 5 depicts an accumulator system with a position sensor according to exemplary embodiments.

According to an exemplary embodiment shown in FIG. 5, accumulators used on an undersea rig can be split into two groups of accumulators: a working group of accumulators 502 (which can include one or more accumulators and has lower pressure requirements, e.g., movement of a ram block without shearing) and a high pressure group of accumulators 504 (which can be one or more accumulators and has higher pressure requirements to, for example, shear a tool). As described in the Background section, an initial discharge from an accumulator is at its highest pressure discharge. Therefore, according to exemplary embodiments, the working group of accumulators 502 can be used for any general working duties which do not require high pressure, e.g., moving a shear ram block 506 located within the shear ram bonnet 510 to a contact position with a drill string 508 (or pipe). The high pressure group of accumulators 504 can be used for operations requiring a high initial burst of pressure, e.g., shearing the drill string 508 and/or pipe after the working group 502 has positioned the ram block 506 next to the drill string 508. For one example, the working group of accumulators 502 could have a pressure of substantially 300 psi (20.7 bar) at an end of a stroke (complete shut off) and the high pressure group of accumulators could have a pressure of substantially 4000 psi (275.8 bar) at the end of its stroke. The end of the stroke for the working group of accumulators is when the ream block 506 is in contact with the drill string 508 or pipe. The end of the stroke for the high pressure group of accumulators 504 occurs when the drill string 508 is sheared and the two ram blocks 506 are in contact with each other.

An associated initial burst of pressure required to shear the drill string 508 can be determined by the diameter of the element(s), e.g., pipe and/or a drill string 508, and associated material properties of the element(s). Therefore, various ranges of pressure configurations can be used for both the working group of accumulators 502 and the high pressure group of accumulators 504 such as an initial pressure, i.e., the initial pressure prior to any use, can be in the range of 1500-6000 psi (103.4-413.7 bar) or more. According to an alternative exemplary embodiment, the initial pressure of the high pressure group of accumulators can be in the range of 4000-5500 psi (275.8-379.2 bar). The working group of accumulators 502 and the high pressure group of accumulators 504 can be at a same or different starting pressure as desired. The high pressure accumulators 504 can also be tied in to the entire pressure system in such a manner as to selectively allow the use of the high pressure accumulators 504 with other rams and well functions as desired.

Figure 6:
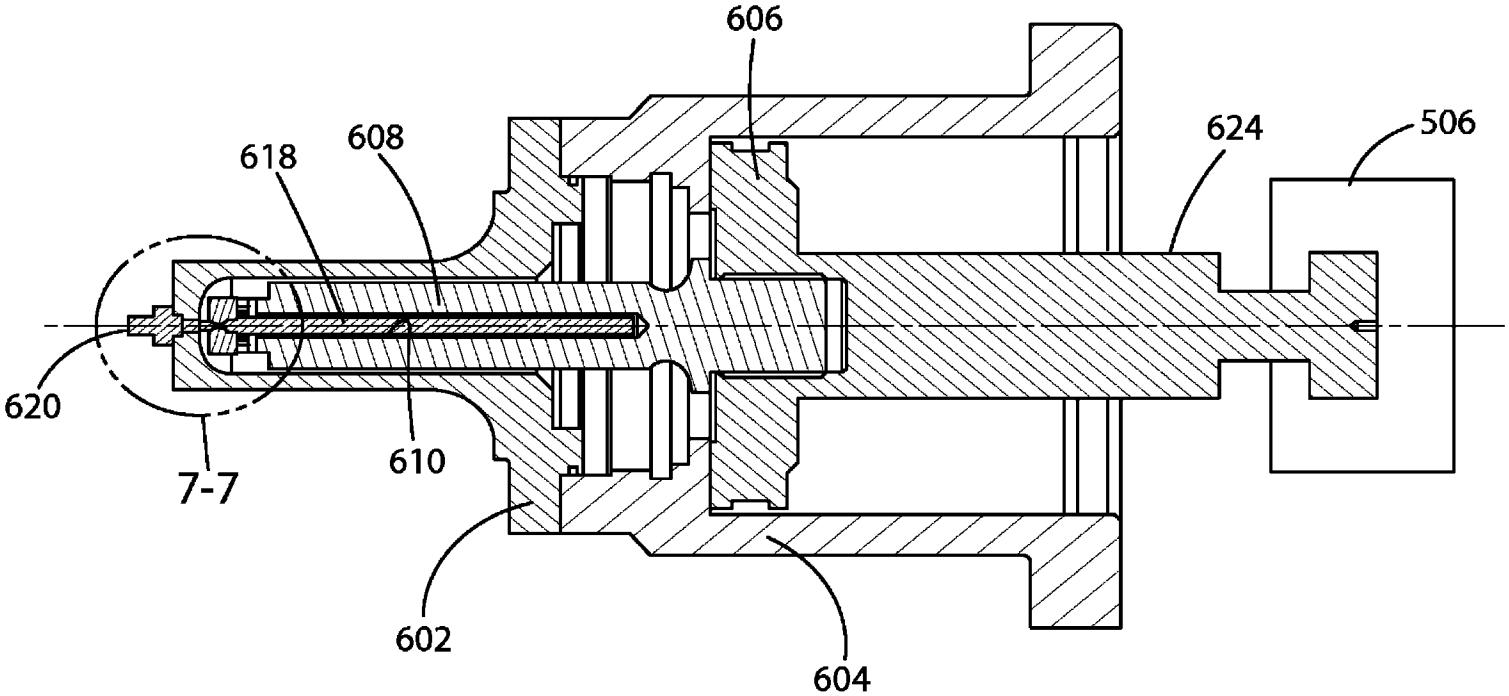
FIGS. 6 and 7 show a cylinder head and sensor arrangement according to exemplary embodiments.
Figure 7:
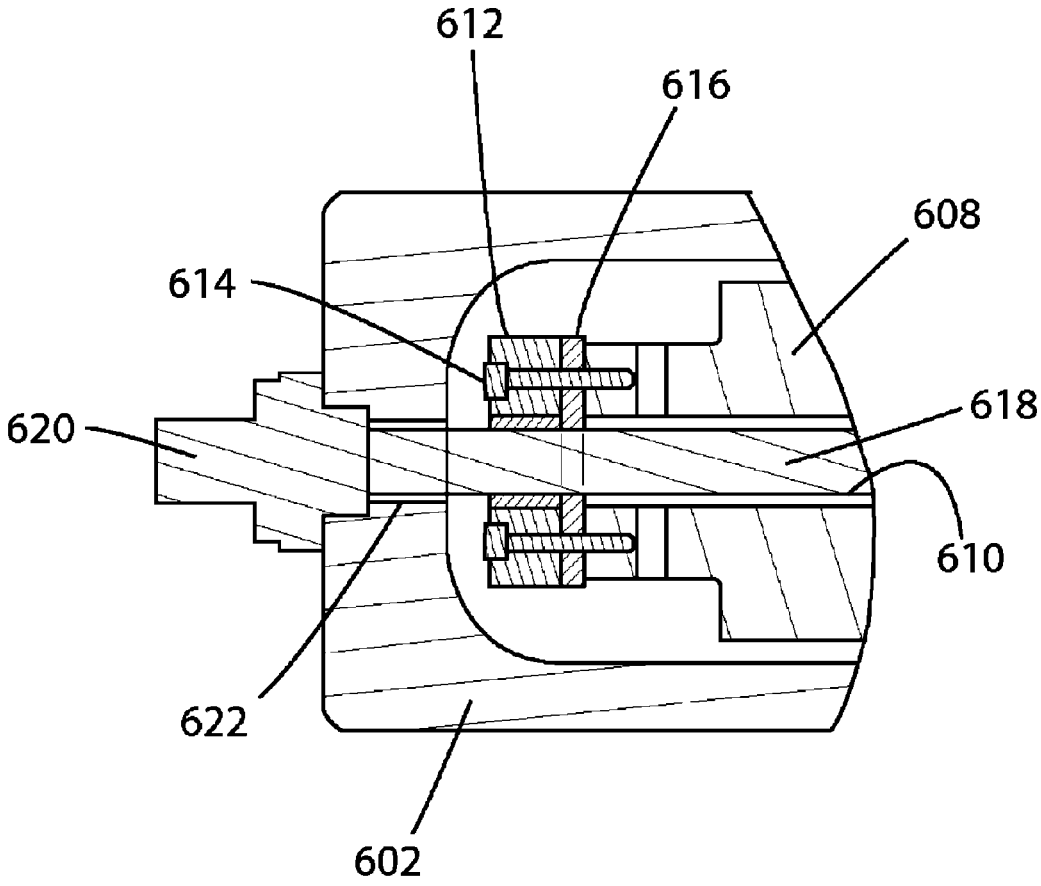

When moving the ram block 506 it can be desirable to know the exact position of the ram block 506 in support of, for example, deciding when to switch from the working group of accumulators 502 to the high pressure group of accumulators 504. According to an exemplary embodiment, a position sensor 512 can be used to determine the position of the ram block 506 within the ram bonnet 510. FIGS. 6 and 7 illustrate a cylinder head and sensor arrangement according to embodiments disclosed herein. Cylinder head 602 may be connected to cylinder 604. Piston 606, shown in its fully opened position, may be connected to piston tail 608 which has a piston tail bore 610 extending at least partially through piston tail 608. Magnet assembly 612 may be concentric with and attached to piston tail 608 via screws 614, e.g., non-magnetic screws in some embodiments. A spacer 616, such as an o-ring, may be placed between magnet assembly 612 and piston tail 608. Magnet assembly 612 may include two or more magnets. A stationary waveguide tube 618 may be located in cylinder head 602, and may at least partially extend into the piston tail bore 610 of piston tail 608.

Additionally, a conducting element or wire (not shown) may be located through the center of waveguide tube 618. Both the wire and waveguide tube 618 may be connected to a transducer 620, located external to cylinder head 602, through a communications port 622. The transducer 620 may also be configured to place an interrogation electrical current pulse on the conducting wire. As ram 624 moves axially, piston tail 608 and magnet assembly 612 axially move the same amount. Thus by the operation of the magnetostrictive sensor disposed therein, it is possible to determine the position of the ram 624 and hence the position of the ram block 506 on a continuous basis. In other words, according to exemplary embodiments, the above described system can act as position sensor 512. More information regarding this exemplary system can be found in U.S. patent application Ser. No. 11/675,861 entitled "RAM BOP Position Sensor" filed on Feb. 16, 2007, the contents of which are incorporated herein by reference. However, other methods for determining the position of the ram block 506 can also be used as desired.

According to an exemplary embodiment, the position sensor 512 can be used to determine when to switch from the working group of accumulators 502 to the high pressure group of accumulators 504. As previously described, according to exemplary embodiments, the working group of accumulators 502 can be used for any general working duties which do not require high pressure, e.g., moving a shear ram block 506 located within the shear ram bonnet 510 to a contact position with a drill string 508 (or pipe), and the high pressure group of accumulators 504 can be used for operations requiring a high initial burst of pressure, e.g., shearing a drill string 508 and/or pipe. Position sensor 512 can determine the location of the ram block 506 and transmit this information to a controller (see controller 1002 in FIG. 10 which is described in more detail below). When the location of the ram block 506 reaches a certain position which indicates that the ram block 506 is in contact with the pipe or drill string 508 (or some other predetermined position), the controller closes the valve 514 and opens the valve 516 which releases a higher pressure to allow the ram block 506 to shear the drill string 508.

Figure 8:
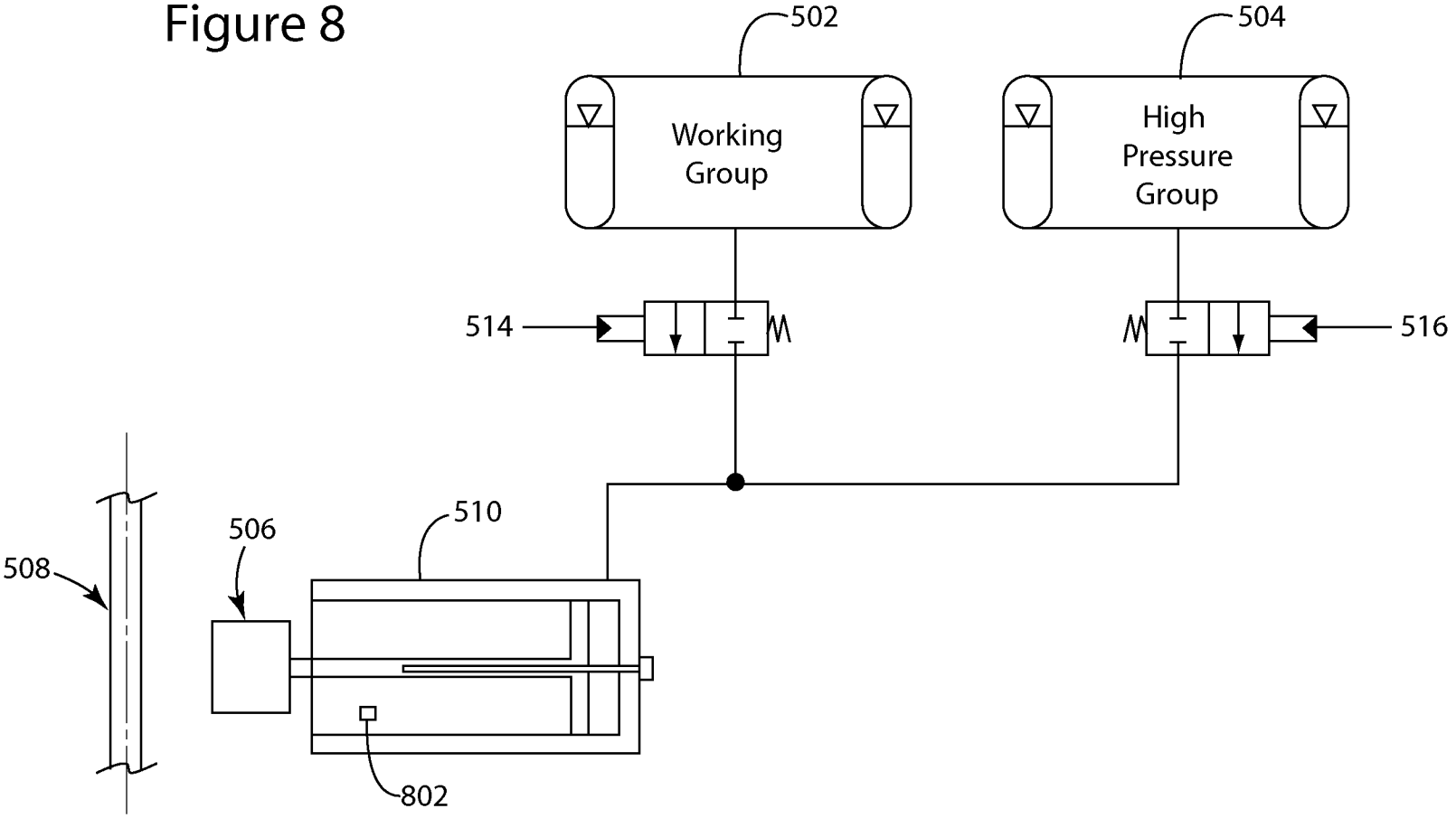
FIG. 8 depicts an accumulator system with a pressure sensor according to exemplary embodiments.

According to another exemplary embodiment, a pressure sensor 802 can be used to determine when to switch from the working group of accumulators 502 to the high pressure group of accumulators 504 as shown in FIG. 8. As previously described, according to exemplary embodiments, the working group of accumulators 502 can be used for any general working duties which do not require high pressure, e.g., moving a shear ram block 506 located within the shear ram bonnet 510 to a contact position with a drill string 508 (or pipe), and the high pressure group of accumulators 504 can be used for operations requiring a high initial burst of pressure, e.g., shearing a drill string 508 and/or pipe. Pressure sensor 802 can determine the amount of pressure being exerted by the ram block 506 and transmit this information to the controller (see controller 1002 in FIG. 10 which is described in more detail below). Pressure sensor 802 can be an absolute or differential pressure transducer. When the pressure becomes greater than a predetermined amount, e.g., approximately 750 psi (51.7 bar), which indicates that the ram block 506 is in contact with the pipe or drill string 508, the controller closes the valve 514 and opens the valve 516 which releases a higher pressure to allow the ram block 506 to shear the drill string 508. According to other exemplary embodiments, other pressure values can be used for the predetermined amount for triggering the controller 1002 to release the high pressure. For example, the predetermined amount can be an adjustable pressure set point in software used by the controller 1002. This allows for the flexibility of having different pressure set points for different operating environments.

According to exemplary embodiments, the position sensor 512 and the pressure sensor 802 can be used in a same system. The position sensor 512 and the pressure sensor 802 can remain as separate redundant systems (though controls can be integrated as desired). According to an alternative exemplary embodiment, the position sensor 512 could also include the pressure transducer allowing them to be integrated in a same device.

Figure 9:
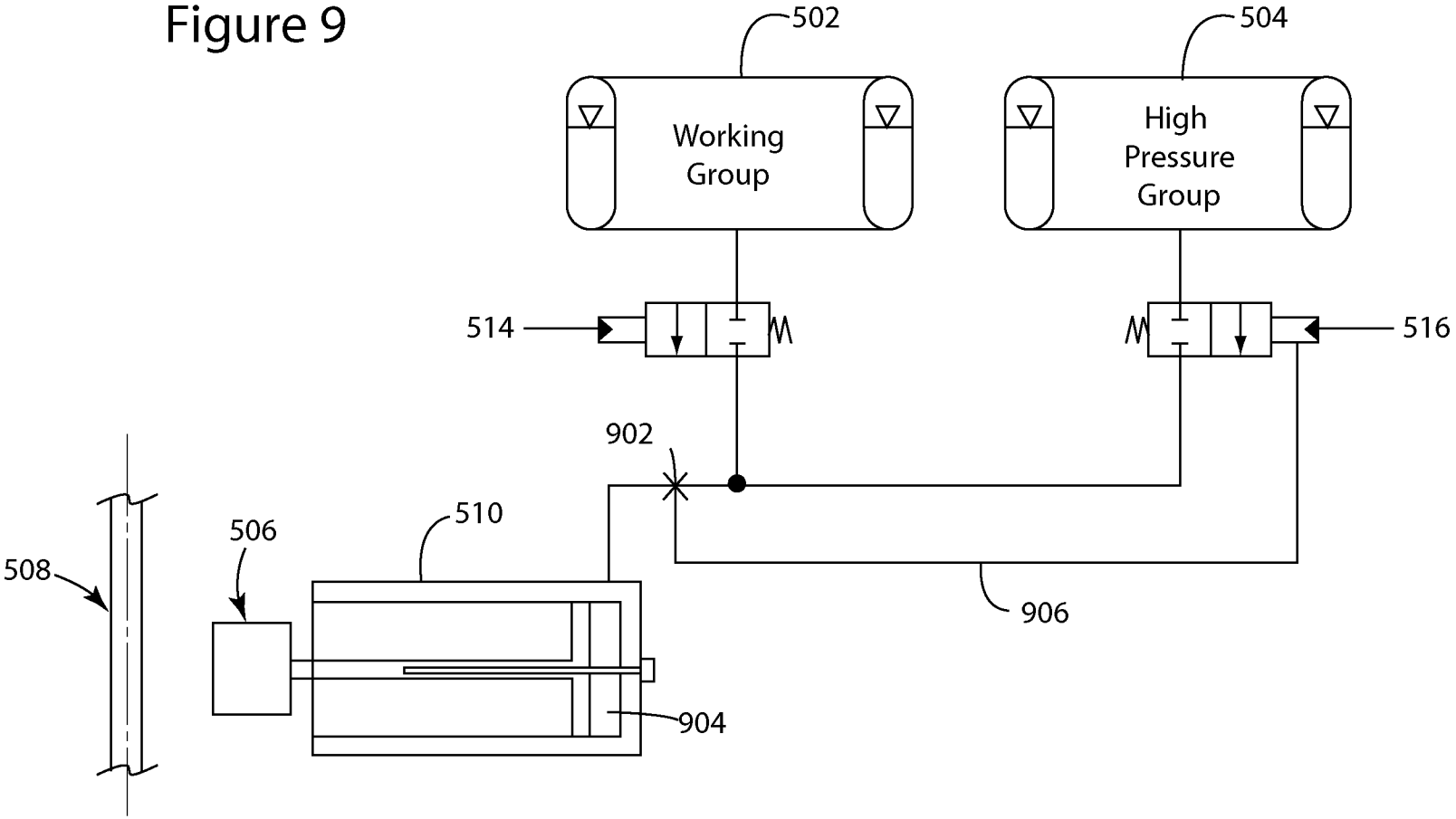
FIG. 9 shows an accumulator system with a relief valve according to exemplary embodiments.

According to another exemplary embodiment, a valve can be used to automatically switch over from the working group of accumulators 502 to the high pressure group of accumulators 504 for shearing a drill string as shown in FIG. 9. Initially, the MUX pod (shown in FIG. 10 as MUX pod 1008 and described in more detail below) decides to or receives instructions to, shear the drill string 508. The working group of accumulators 502 is used to move the ram block 506 into contact with the drill string 508. Once the ram block 506 is in contact with the drill string 508, the pressure in the cavity 904 increases while the working group of accumulators 502 is open since the pressure provided is not enough to force the ram block 506 to shear the drill string 508 which keeps the available volume constant. When this pressure reaches a predetermined value, e.g., 750 psi (51.7 bar), a valve 902, e.g., a relief valve, opens which allows some of the pressurized medium from the working group of accumulators 502 via pipe 906, to open the valve 516. When the valve 516 is opened, the pressurized medium from the high pressure group of accumulators 504 moves the ram block 506 allowing it to shear the drill string 508. According to other exemplary embodiments, other pressure values can be used for the predetermined amount for triggering the valve 902. For example, the valve 902 can have a range through which the predetermined amount can be adjustably set, such as, a set point range of 300-1000 psi (20.7-68.9 bar). This allows for the flexibility of having different pressure set points for different operating environments.

Figure 10:
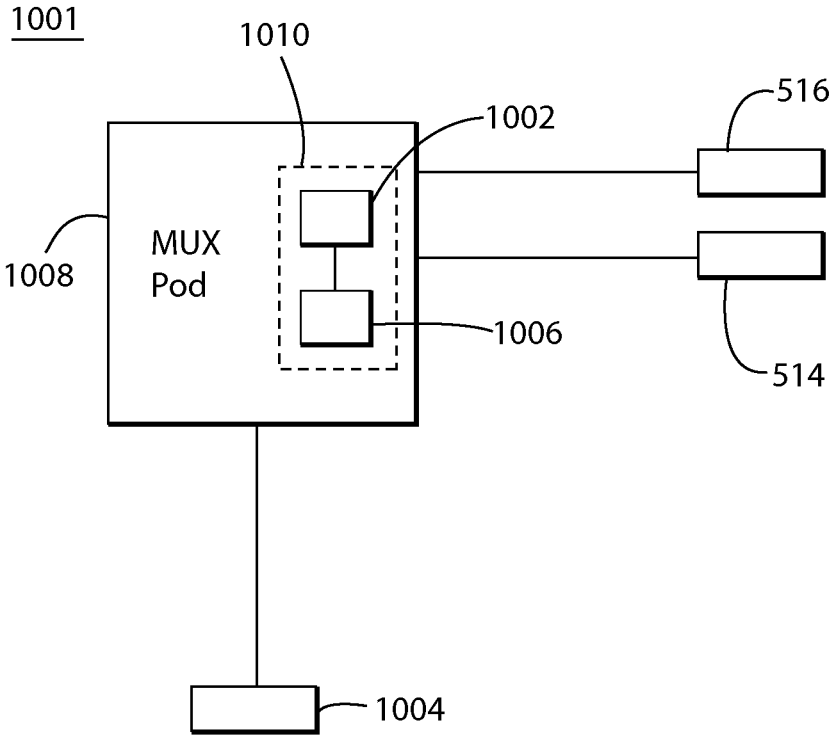
FIG. 10 shows a control system according to exemplary embodiments.

According to exemplary embodiments, a control system 1001 as shown in FIG. 10 can be used to determine when to used which group of accumulators for moving the ram block 506. A controller 1010 includes a processor 1002 and a memory 1006. Software for operating the control system 1001 can be stored in the memory 1006 and executed by the processor 1002. The controller 1010 is shown to be located on the MUX pod 1008, however the controller 1010 can also be located at a surface unit where an operator can interface with the system, or at both locations. The system can be fully automated, manually operated or some combination thereof. The control system 1001 shows the MUX pod 1008 in communications with valves 514, 516 and a sensor 1004 which may be either the position sensor 512, the pressure sensor 802 or a combined device which includes the functions of both the position sensor 512 and the pressure sensor 802.

For ease of description, the following exemplary embodiments will be generally described from the point of view of an automatically operated system controlled by the MUX pod 1008, however, as previously described, other options can be performed with the exemplary embodiments described herein. Communication links can be electrical, mechanical, hydraulic and/or combinations thereof. Additionally, while not described in detail in this section, it is to be understood that the MUX pod 1008 can also operate and include the functions of current MUX pods to include, but not be limited by, the information described in the Background section.

According to another exemplary embodiment, the velocity of the ram block 506 can be monitored by the controller 1010 for use in determining when to close the valve 514 and open the valve 516 which releases a higher pressure to allow the ram block 506 to shear the drill string 508. As described above, the position sensor 512 is in communications with the controller 1010 which allows the controller 1010 to have real time position information of the ram block 506. A distance traveled over time can be derived by the controller 1010 (since position and time information is available to the controller 1010) which then allows for calculating the velocity of the ram block 506. When the ram block 506 is in contact with the drill string 508 and/or pipe the velocity of the ram block 506 goes to zero. When the calculated velocity is zero or approaching zero (or any other velocity set point desired) the controller 1010 may be configured to close the valve 514 and opens the valve 516 which releases a higher pressure to allow the ram block 506 to shear the drill string 508.

According to exemplary embodiments, the MUX pod 1008 receives information regarding various parameters associated with an undersea well. When information (either locally gathered or remotely sent) indicates that the BOPs need to be closed, the MUX pod 1008 can control the shear ram block 506 to shear the well, including any drill strings that may be in the well, to allow for future sealing of the well.

Figure 11:
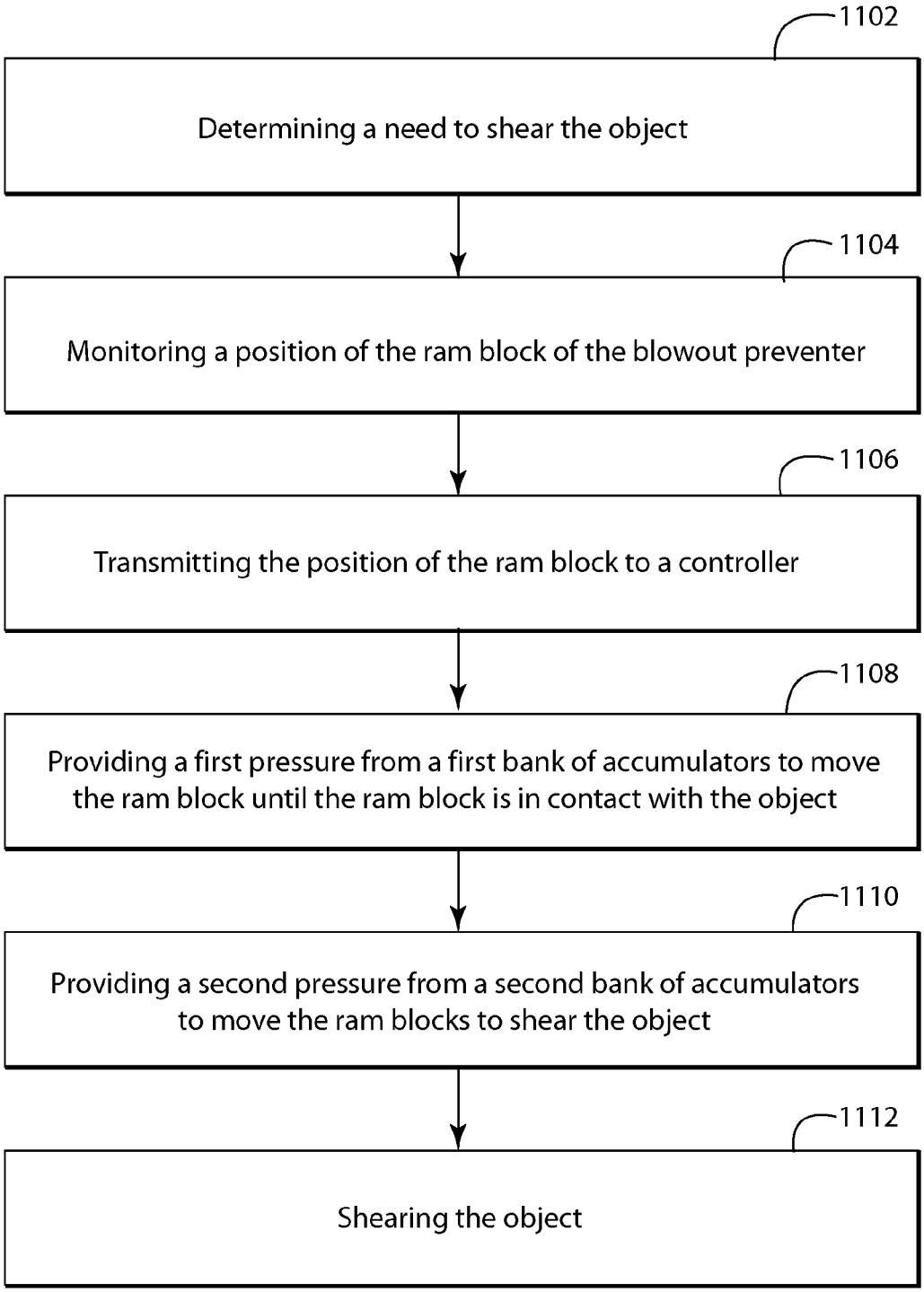
FIG. 11 illustrates a method flowchart for shearing a drill string in a well according to exemplary embodiments.

Utilizing the above described exemplary embodiments, a method for shearing an object in a blowout preventer is shown in the flowchart of FIG. 11. The method for shearing the object includes: a step 1102 of determining a need to shear the object; a step 1104 of monitoring a position of a ram block of the blowout preventer; a step 1306 of transmitting the position of the ram block to a controller; a step 1108 of providing a first pressure from a first bank of accumulators to move the ram block until the ram block is in contact with the object; a step 1110 of providing a second pressure from a second bank of accumulators to move the ram block to shear the object; and a step 1112 of shearing the object. Upon completion of shearing, the ram block(s) 506 will be in contact with each other and the MUX pod knows 1008 this from information received from the position sensor 512, allowing the MUX pod 1008 to then use either group of accumulators 502 and 504 as desired.

According to exemplary embodiments, using the above described exemplary systems and methods the quantity (or overall volume) of the accumulators used for shearing a tool can be reduced. Since a high pressure group of accumulators 504 are "kept in reserve" for use to shear a pipe and/or drill string 508, fewer accumulator bottles can be stored at the undersea well site. The quantity/size of accumulator bottles used in the high pressure group of accumulators 504 is dependent upon what is expected to be sheared and therefore the reduction of the quantity/size of accumulator bottles will vary for each specific application.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims. No element, act, or instruction used in the description of the present application should be construed as critical or essential to the invention unless explicitly described as such. Also, as used herein, the article "a" is intended to include one or more items.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The invention claimed is:

1. A system configured to move a ram block in a blowout preventer, the system comprising:

a source of pressurized fluid in selective communication with the ram block;

a position sensor in communication with an element coupled with the ram block; and a controller in communication with the source of pressurized fluid and in communication with the position sensor, so that when the ram block moves into contact with a tubular and the position sensor communicates a signal to the controller indicating the element is at a designated position, the controller selectively increases a pressure of the fluid communicated to the ram block, wherein the controller estimates a velocity based on a duration of time from which the ram block moves from a first location and into contact with the tubular.

2. The system of claim 1, wherein the position sensor comprises a magnet in the element that moves with the element and the ram block, and a magnetostrictive sensor disposed stationary with respect to the magnet, so that a signal from the magnetostrictive sensor to the controller indicates an exact location of the ram block.

3. The system of claim 1, wherein the source of pressurized fluid comprises vessels having the pressurized fluid, and wherein a pressure in a one of the vessels is greater than a pressure in another one of the vessels.

4. The system of claim 1, wherein the tubular comprises one of a tool or a drill string.

5. The system of claim 1, wherein the ram block is a shear ram block located in the blowout preventer.

6. A system for use with a blowout preventer comprising:

a position sensor in locational communication with a ram block in the blowout preventer;

a low pressure accumulator containing a fluid that is in selective communication with the ram block;

a high pressure accumulator containing a fluid that is in selective communication with the ram block and at a pressure that is greater than a pressure of the fluid in the low pressure accumulator; and a controller in communication with the position sensor, low pressure accumulator, and high pressure accumulator, so that when the controller estimates a velocity based on a duration of time from which the ram block moves from a first location and into contact with a tubular, the controller initiates communication between the high pressure accumulator and the ram block.

7. A method of operating a blowout preventer comprising:

monitoring a position of a ram block of the blowout preventer;

moving the ram block with fluid and towards a tubular in the blowout preventer;

estimating a velocity of the ram block based on a duration of time from which the ram block moves from a first location and into contact with the tubular;

and increasing a pressure of the fluid when the ram block is monitored to be at a designated velocity.

8. The method of claim 7, wherein the ram block is in contact with the tubular in the blowout preventer when in a designated location.

9. The method of claim 7, further comprising continuing to provide the fluid so that the ram block shears the tubular in the blowout preventer.

10. The method of claim 7, wherein the fluid is provided from vessels maintained at different pressures, so that the step of increasing a pressure of the fluid comprises providing fluid from a vessel having a higher pressure.

* * * * *